343-700 MS AU 256 EX
12/30/80 XR 4,242,685

United States Patent [19]
Sanford

[11] 4,242,685
[45] Dec. 30, 1980

[54] SLOTTED CAVITY ANTENNA

[75] Inventor: Gary G. Sanford, Boulder, Colo.
[73] Assignee: Ball Corporation, Muncie, Ind.

[21] Appl. No.: 34,135
[22] Filed: Apr. 27, 1979
[51] Int. Cl.³ ..... H01Q 13/18
[52] U.S. Cl. ..... 343/770; 343/700 MS; 343/853
[58] Field of Search ..... 343/700 MS, 767, 771, 343/789, 908, 770, 853, 854

[56] References Cited

U.S. PATENT DOCUMENTS

| | | | |
|---|---|---|---|
| 2,557,951 | 6/1951 | De Rosa et al. | 343/771 |
| 3,009,153 | 11/1961 | Masters et al. | 343/789 |
| 3,478,362 | 11/1969 | Ricardi et al. | 343/908 |
| 3,573,834 | 4/1971 | McCabe et al. | 343/789 |
| 3,806,945 | 4/1974 | Proctor | 343/767 |
| 3,971,032 | 7/1976 | Munson et al. | 343/770 |
| 4,012,741 | 3/1977 | Johnson | 343/700 MS |
| 4,017,864 | 4/1977 | Proctor | 343/767 |
| 4,051,477 | 9/1977 | Murphy et al. | 343/700 MS |
| 4,130,822 | 12/1978 | Conroy | 343/700 MS |
| 4,131,292 | 12/1978 | Munson et al. | 343/700 MS |
| 4,131,893 | 12/1978 | Munson et al. | 343/700 MS |
| 4,170,013 | 10/1979 | Black | 343/700 MS |

OTHER PUBLICATIONS

Howe, Jr., Stripline Circuit Design, Microwave Associates, Chapter 3, pp. 77–85, 1974.
Reference Data for Radio Engineers, Fourth Edition, International Telephone and Telegraph Corp., pp. 633–635.
Lindberg, A Shallow-Cavity UHF Crossed-Slot Antenna, Technical Report No. 446, MIT Lincoln Lab., pp. 3–19, Mar. 8, 1968.

*Primary Examiner*—Eli Lieberman
*Attorney, Agent, or Firm*—Gilbert E. Alberding

[57] ABSTRACT

A resonant cavity having at least one radiating antenna slot formed in a wall of the cavity includes an electrically conducting plate disposed within the cavity and substantially spaced from all internal cavity walls so as to effectively lengthen the electrical resonant dimensions of the cavity for a given physical size. This slotted cavity antenna permits the use of simplified feeding structures, provides a more efficient antenna structure and reduces the necessary physical dimensions of the structure for operation at a given frequency.

37 Claims, 11 Drawing Figures

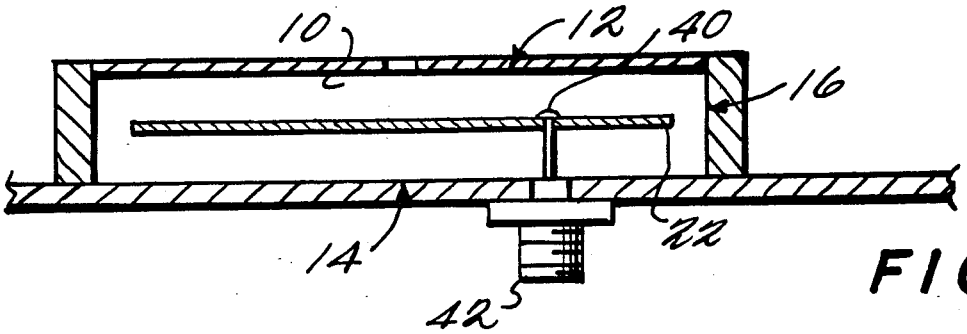
FIG. 7
FIG. 8
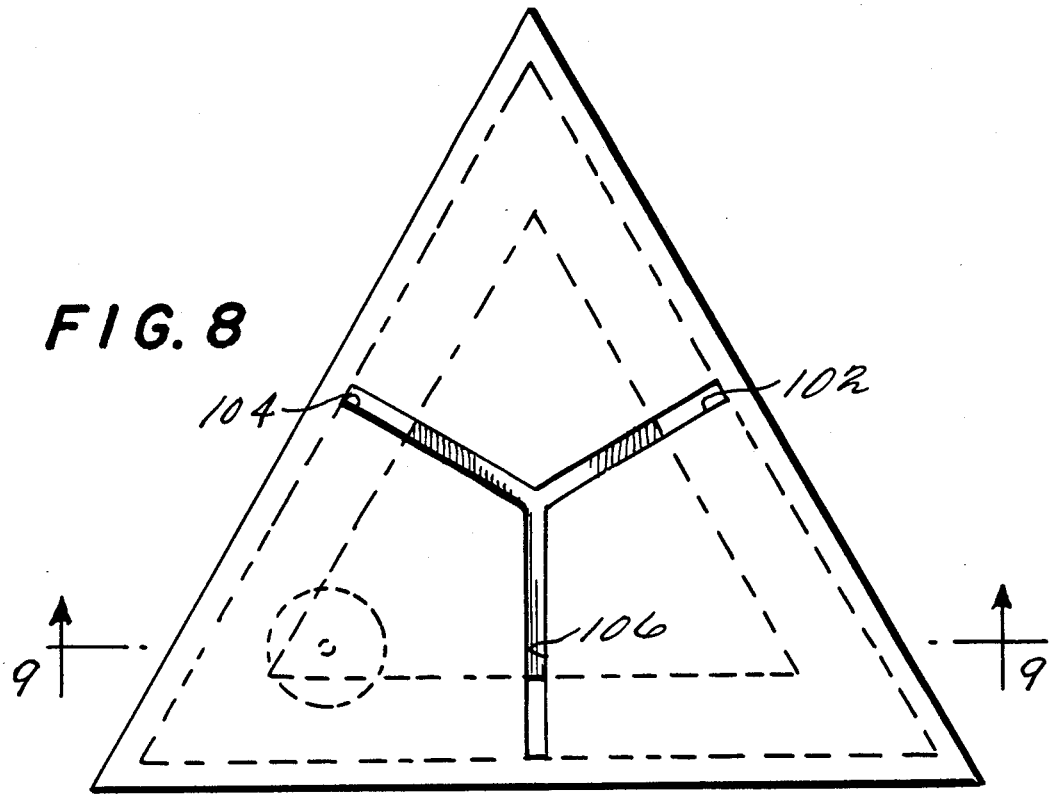
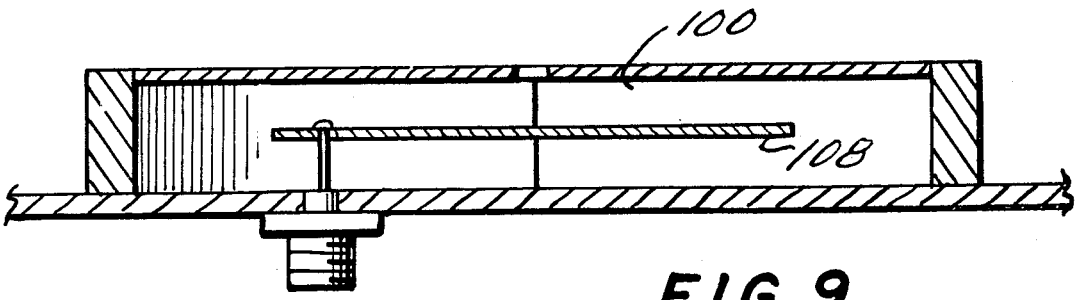
FIG. 9

SLOTTED CAVITY ANTENNA

This invention relates generally to slotted cavity antenna structures. The preferred exemplary embodiment utilizes a crossed slot antenna.

Slotted cavity antennas and, in particular crossed slot cavity antenna structures, are well known in the art. A crossed slot antenna provides one of the widest beamwidth radiation patterns of all conformal radiating elements. However, in the past, the feed network required has been relatively complex and has represented increased manufacturing costs and reduced antenna efficiency. For some particular applications, the required size of the usual crossed slot antenna structure has also remained as an undesirable factor.

Microstrip radiators include a resonant cavity associated with a radiating aperture. However, the radiating aperture associated with a microstrip radiator is formed between the edge of one conductive plate and an underlying ground plane whereas the radiating apertures in a slotted cavity antenna are formed on the surface of one wall in a resonant cavity. Microstrip radiators are now well known in the art and, in addition, some forms of microstrip radiators in the prior art have utilized folded resonant cavities so as to reduce their necessary physical dimensions. For example, attention is directed to U.S. Pat. Nos. 4,131,892 and 4,131,893, all commonly assigned herewith.

There have also been prior microstrip antenna structures having intersecting radiating apertures. For example, attention is drawn to the commonly assigned U.S. Pat. No. 3,971,032 where such intersecting radiators are fed with integrally formed strip feed lines disposed in the spaces between the apertures.

Now it has been discovered that conventional slotted cavity antenna structures may be substantially improved by disposing an electrically conductive plate within the cavity and substantially spacing it from all internal cavity walls so as to lengthen the effective electrical resonant dimensions of the cavity for a given physical size. In one embodiment, the plate is electrically connected near its mid-point to a wall of the cavity opposite the wall having the radiating slots. In another embodiment, the inner conductor of a coaxial connection is connected to a point on the plate which is substantially removed from its mid-point.

The plate is preferably substantially centrally disposed within the cavity so as to, in effect, equally divide and "fold" the available space into a resonant cavity having a longer effective resonant dimension. The plate is also preferably shaped so as to be substantially similar to the shape of a cross-section of the resonant cavity taken along a plane parallel to the wall having the radiating slots. Of course, the plate would be somewhat smaller in its respective corresponding dimensions than such a cross-section. The plate is preferably shaped and disposed within the resonant cavity so as to be substantially symmetric in shape and disposition with respect to each of the radiating slots.

The resonant cavity may take on a wide variety of cross-sectional shapes. For example, the resonant cavity may comprise a right circular cylinder or a cylinder having a square, triangular or other polygonal cross-section.

In addition, the plate disposed within the resonant cavity may be conveniently formed as a layer of electrically conductive material bonded to one side of a dielectric sheet. Especially in this instance, a phase-shifting circuit may also be included within the resonant cavity and formed by etched stripline bonded to the other side of the dielectric sheet. The shape of the plate itself may also be varied so as to achieve particular phase distributions within the resonant cavity and across the radiating apertures.

With this invention, the slotted cavity antenna, and in particular a crossed slot antenna, is made more efficient in operation and smaller in size for a given frequency of operation. The feed structure is also considerably simplified.

These and other objects and advantages of this invention will be more completely understood and appreciated by reading the following detailed description of the presently preferred exemplary embodiments taken in conjunction with the accompanying drawings, of which:

FIGS. 6 and 7 illustrate another exemplary embodiment of the invention;

FIGS. 8 and 9 illustrate yet another exemplary embodiment of the invention.

Figure 1:
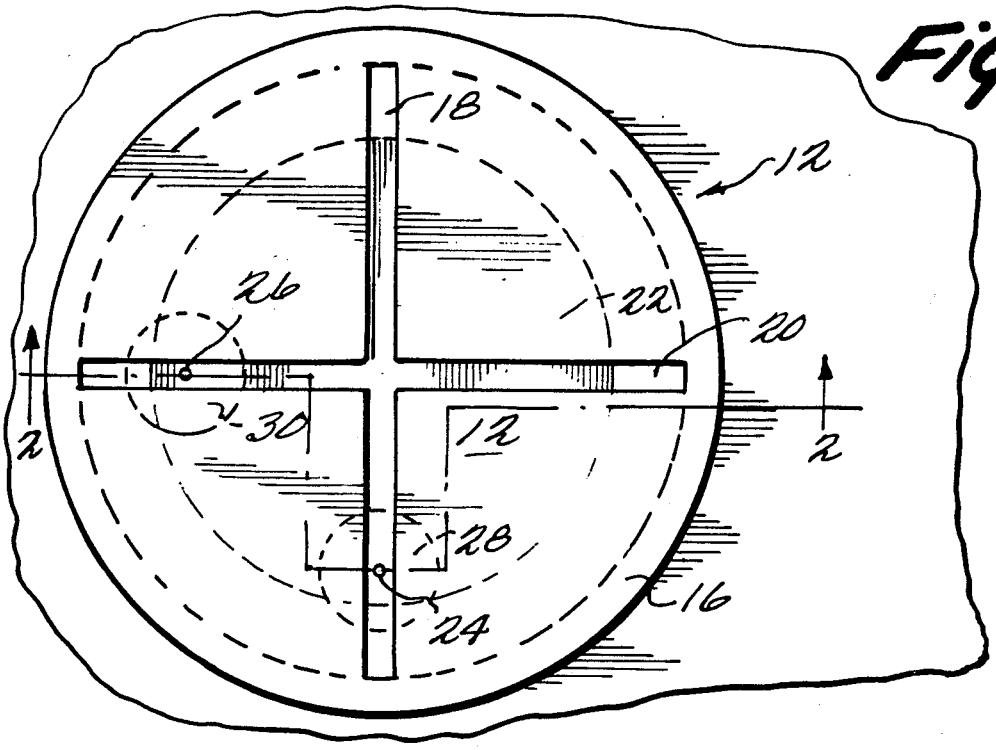
FIGS. 1 and 2 illustrate a first preferred exemplary embodiment of the invention.
Figure 2:
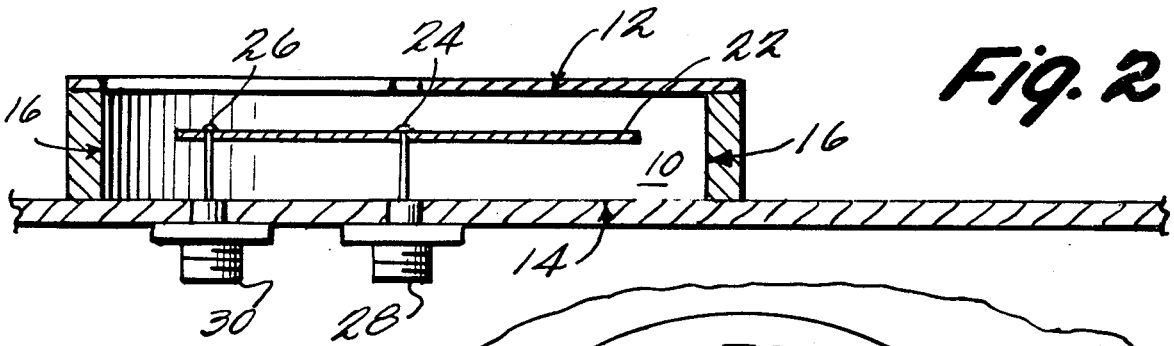

The crossed slot antenna shown in FIGS. 1 and 2 includes the usual resonant cavity 10 as defined by electrically conductive walls 12 and 14 connected together by side walls 16 to form an enclosed resonant cavity. Intersecting radiating slots 18 and 20 are cut into the wall 12 as shown.

Such a crossed slot antenna has the widest beamwidth of all conformal radiating elements and, in particular, the beamwidth is wider than that of a standard microstrip radiator. At least in part, this is so because the effective aperture of the crossed slot is smaller than the aperture of a typical microstrip radiator. Such a wide beamwidth is a significant advantage in many applications.

However, the crossed slot antenna has in the past required a rather complex feeding network. For example, the four quandrants of the antenna structure must be fed with equal amplitudes progressing in phase successively by 90 degree intervals. The usual feed network involves significant lengths of transmission line and, in some cases, crossing transmission lines. Such a complex feeding network increases manufacturing costs and reduces the efficiency of the antenna. Some have proposed the use of phase-shifting strip-line circuits disposed within the cavity heretofore in an attempt to simplify the feeding arrangements. (e.g. see Technical Report No. 446 from Lincoln Laboratory at MIT entitled "A Shallow Cavity UHF Crossed-Slot Antenna" and dated Mar. 8, 1968) However, even here, each of the quandrants was excited with a separate coupling element.

Another disadvantage of a conventional crossed slot antenna using a relatively thin resonant cavity is that it requires more surface area than a typical microstrip radiator operating at the same frequency. This is so, for example, because the resonant cavity behind a crossed slot radiator is in actuality a true wave guide resonator in which resonate dimensions are longer than in free space.

However, the exemplary embodient of the invention shown in FIGS. 1 and 2 substantially alleviates the earlier noted disadvantages of a traditional crossed slot antenna while maintaining the substantial advantages of such a structure. This is achieved in FIGS. 1 and 2 by locating an electrically conductive plate 22 within the resonant cavity 10. In some senses, the plate 22 may be thought of as a microstrip radiator having two feed points 24 and 26 which respectively excite the two orthogonal slots 18 and 20. The exact location of feed points 24 and 26 is chosen so as to obtain impedance matching as should be apparent to those in the art. Isolation between the two feed ports is better than 20 dB.

The feed points 24 and 26 may be fed conventionally through coaxial connectors 28 and 30. A quadrature hybrid circuit can, for example, be connected to the two feed ports 28 and 30 so as to provide circular polarization of the crossed slot apertures. Alternatively, the feed ports 28 and 30 may be fed separately to obtain a desired one of the respectively corresponding orthogonal linear polarizations corresponding thereto.

The exemplary embodiments shown in the drawings leave the resonant cavity void or simply filled with ambient air or gases, if any. However, it should be appreciated that the cavity may be filled with any good dielectric material such as, for example, teflon fiberglass disks. Furthermore, the cavity and microstrip disk need not be round, but rather, they could have square or other symmetrical shapes with respect to the crossed slots. One example of such other shapes will be discussed in more detail with respect to FIGS. 8 and 9.

Figure 10:
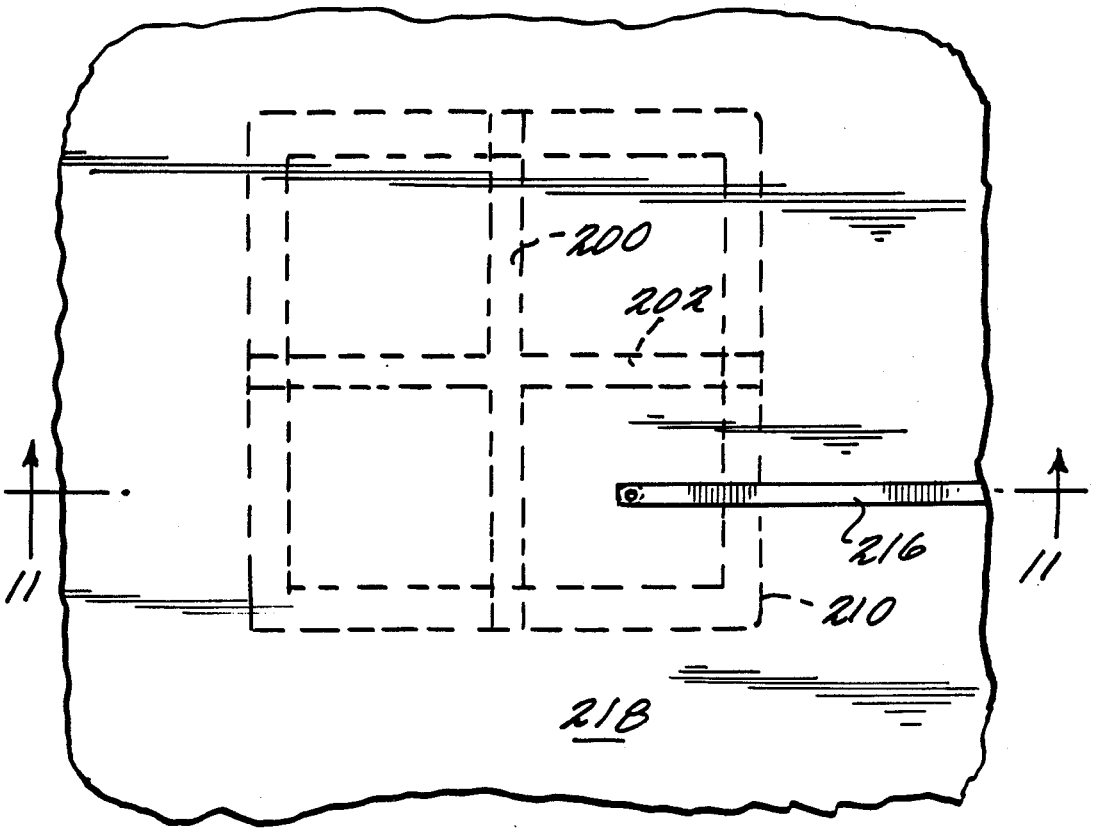
FIGS. 10 and 11 illustrate an exemplary embodiment having radiating slots flush with the surrounding ground plane and being fed by microstrip line passing thereover.
Figure 11:
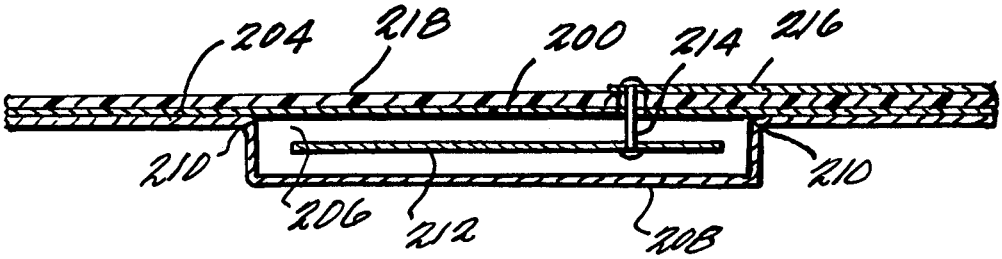

Although the exemplary embodiments are shown as being disposed with the radiating apertures in a plane above the ground plane, it will be appreciated that the cavity can also be disposed with its top surface 12 disposed flush with the surrounding ground plane as is commonly done in practice (e.g. see FIGS. 10 and 11). Furthermore, the cavity may be disposed on a pedestal in a manner similar to that taught by commonly assigned U.S. Pat. No. 4,051,477 so as to even further enhance the broad beamwidth characteristics of the antenna.

The diameter of the resonant cavity in FIGS. 1 and 2 is approximately ½ wavelength although the exact size will depend to some extent upon the size of the disk, the depth of the cavity, the size of the slots, etc. Accordingly, the exact dimensions for any given frequency of operation are probably best determined by trial and error procedures well known to those in the art.

Figure 6:
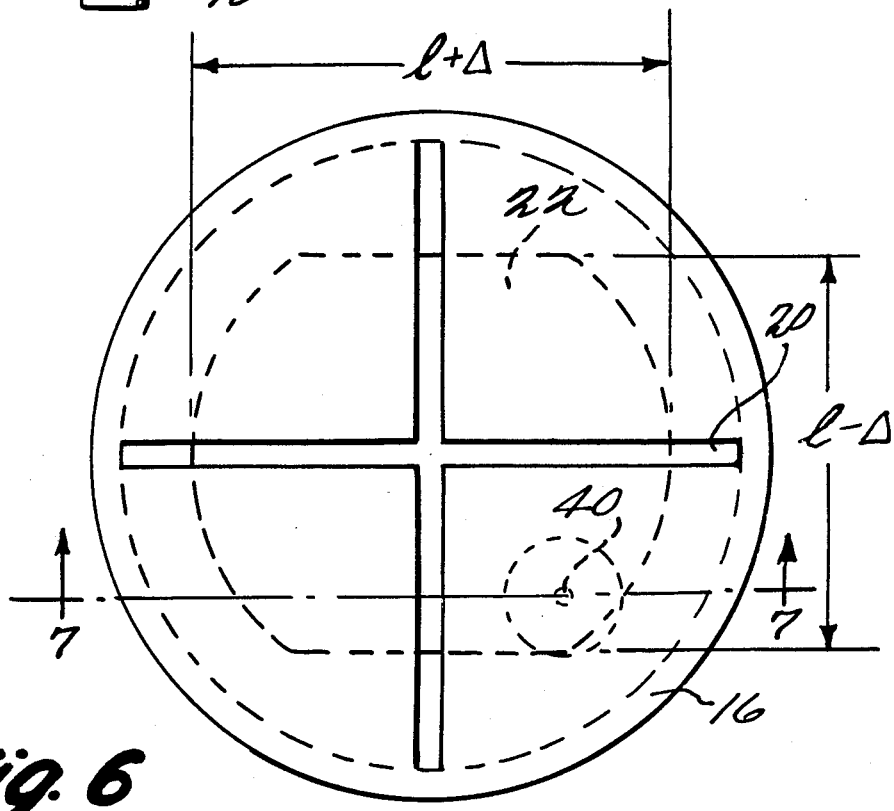

The embodiment shown in FIGS. 6 and 7 is very similar to that shown in FIGS. 1 and 2 and like elements have been given similar reference numerals. However, in FIGS. 6 and 7, the disk 22 is slightly eliptical in shape or, in general, at least slightly unequal in two orthogonal dimensions. One such dimension is slightly shortened so as to provide an inductive reactance equal to the real part of the impedance while the other dimension is slightly lengthened so as to provide a capacity of reactance equal to the real part of the impedance. When element 22 is then fed half way between the two axes of these orthogonal dimensions, the power is divided equally between the two orthogonal modes and the input impedance angles for the two modes are respectively plus 45 degrees and minus 45 degrees such that the radiated fields from apertures 18 and 20 are in phase quadrature and thus circularly polarized with but a single feed point 40 connected to the inner conductor of a standard coaxial connection 42. The distribution of fields over the circular or eliptical disk 22 is similar to that experienced with a similarly shaped microstrip radiator patch.

The exemplary embodiment shown in FIGS. 6 and 7 has been successfully built and operated for an operating frequency of 1.69 GHz. At that frequency, a wavelength is approximately 7 inches in air. The internal dimensions of the resonant cavity were approxiately 3.2 inches in diameter by ½ inch in height. The radiating slots were approximately 0.3 inch wide and 3.2 inches long. Plate 22 was copper-plated aluminum approximately 0.025 inch thick and supported by a nylon screw disposed in the center of the disk. (Clearly any other form of dielectric support material or honeycomb dielectric structure or the like could also be used for physical support.)

The plate 22 was slightly eliptical in shape having a major axis of approximately 2⅞ inches and a minor axis of 2⅝ inches. The single feed point is located equidistance between the major and minor axes approximately ¾ of an inch radially inwardly from the outer wall of the resonant cavity.

Figure 3:
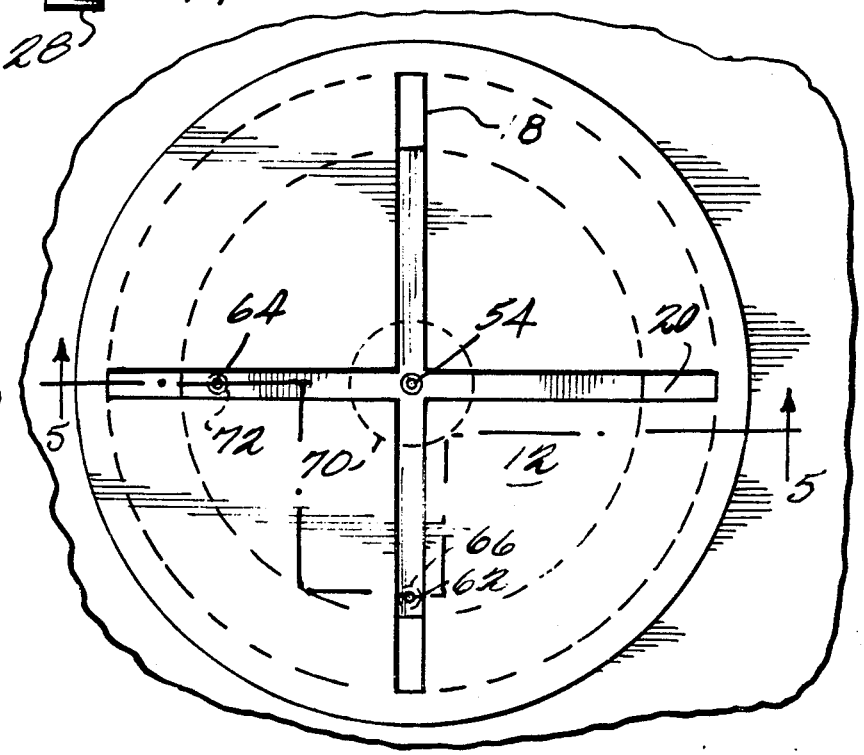
FIGS. 3–5 illustrate a second preferred exemplary embodiment of the invention with FIG. 4 particularly illustrating the phase-shifting circuit etched onto one side of a dielectric sheet.
Figure 4:
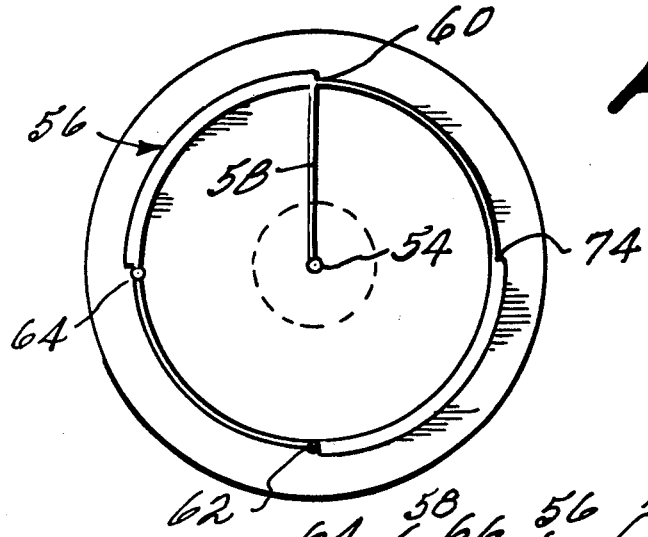
Figure 5:
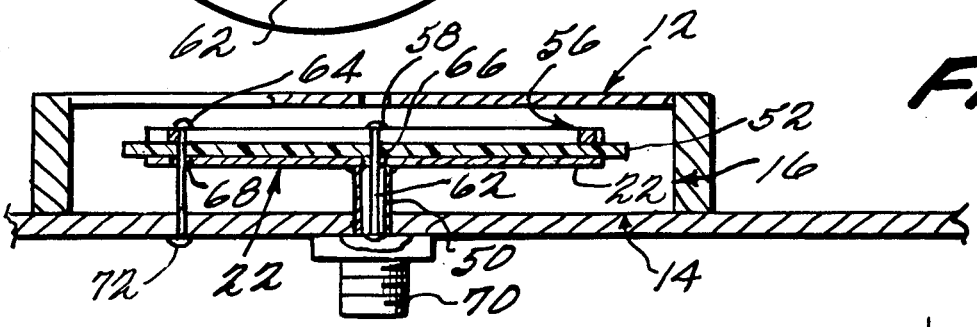

The embodiment shown in FIGS. 3–5 is also somewhat similar to that shown in FIGS. 1 and 2. Namely, it also comprises the usual crossed radiating slots 18 and 20 formed in one wall 12 of a resonant cavity 10. A circular disk 22 is also disposed substantially midway between the upper and lower walls of the resonant cavity.

However, disk 22 in FIGS. 3–5 is connected near its mid-point to the outer conductor of a coaxial connector 50 which is also electrically connected to the lower wall 14 of the resonant cavity. In other words, in FIGS. 3–5, the plate 22 is connected near its mid point to the lower wall 14 of the resonant cavity 10. Furthermore, plate 22 is bonded to a dielectric sheet 52.

The inner conductor 54 from the coaxial connection 50 is fed through the dielectric sheet 52 to a quadrature hybrid microstrip circuit 56 etched onto the opposite side of dielectric sheet 52 from a conductive layer bonded thereto. As seen in FIG. 4, the center conductor 54 of the coaxial connection 50 is fed through to a radial microstrip line 58 connected to feed a conventional quadrature hybrid circuit 56 at one of its ports 60. Since the coaxial connector is located centrally at a natural low voltage location of the resonant cavity, it does not materially disturb the fields within the cavity.

The two orthogonal modes for the radiating slots 18 and 20 are excited respectively by two probes connecting the output ports 62 and 64 of the quadrature hybrid circuit to the bottom wall 14 of resonant cavity 10 at points 70 and 72. These probes are connected through apertures 66 and 68 in the plate 22 bonded to the underside of dielectric sheet 52. The fourth port 74 of the quadrature hybrid circuit is preferably connected to a matched load. However, it may alternatively be connected to another centrally located coaxial line through another radial microstrip line so as to permit operation with the opposite sense of circular polarization.

The embodiment shown in FIGS. 8 and 9 represents one of several possible polygonal or other non-circular cross-sectional shapes which may be utilized for the resonant cavity and the conductive plate disposed therewithin in accordance with this invention. For example, if the cross-sectional shape of the resonant cavity 100 is triangular as shown in FIGS. 8 and 9, then the radiating slots 102, 104 and 106 are disposed symmetrically with respect to the cross-sectional shape and the plate 108 is substantially symmetric in shape and disposition with respect to each of the radiating slots. (A triangular form of microstrip radiator is disclosed in commonly assigned U.S. Pat. No. 4,012,741.) In the embodiment of FIGS. 8 and 9, the triangular plate 108 is slightly irregularly shaped so as to produce circular polarization. The operation of the antenna is similar to that already described with respect to FIGS. 6 and 7 except that the three radiating slots are excited in a phase progression of zero degrees, 120 degrees and 240 degrees rather than a progression of zero degrees, 90 degrees, 180 degrees and 270 degrees as with the four radiating apertures formed by the two intersecting slots 18 and 20 in FIGS. 6 and 7.

In the embodiment of FIGS. 10 and 11 the radiating slots 200 and 202 are formed in the ground plane 204 which also bounds one side of the resonant cavity 206. The remainder of the resonant cavity is stamped from a metal sheet 208 and connected to the overlying ground plane 204 at boundary 210. Metal plate 212 is suspended in the center of the cavity 206 and functions like plate 22 of the earlier discussed embodiments. However, in FIGS. 10–11, the r.f. feed to plate 212 is via pin 214 from microstrip line 216. In this exemplary embodiments, the ground plane 204 is bonded to one side of a dielectric sheet 218 (e.g., teflon-fiberglass) and the microstrip line 216 is bonded to the other side of the dielectric sheet. The microstrip line 216 may be formed by conventional photo sensitive etching processes used for manufacturing printed circuit boards.

In all of the embodiments, the electrically conductive plate disposed within the resonant cavity effectively folds the cavity so as to present a longer electrically resonant dimension thus reducing the actual resonant frequency of the structure. Accordingly, for any given constant frequency of operation, the surface area of the antenna can be reduced significantly from that which would have been required without the use of such a plate.

Although only a few exemplary embodiments of this invention have been described in detail above, those in the art will recognize that many modifications and variations of these exemplary embodiments may be made without departing from the novel and advantageous features of this invention. Accordingly, all such modifications and variations are intended to be included within the scope of this invention as defined by the appended claims.

What is claimed is:

1. A crossed slot antenna comprising:
a resonant cavity having plural intersecting radiating slots formed in one wall thereof,
an electrically conductive plate disposed within said cavity and substantially spaced from all internal cavity walls thereby lengthening the effective electrical resonant dimensions of the cavity for a given physical size of cavity, and
r.f. feed means electrically connected to at least one point on said plate, substantially removed from its midpoint, for feeding r.f. signals to/from each of said plural slots via said plate with predetermined respectively corresponding relative phase relationships.

2. A crossed slot antenna as in claim 1 wherein said plate is electrically connected near its mid-point to a wall of said cavity opposite the wall having said slots formed therein.

3. A crossed slot antenna as in claim 1 further comprising at least one coaxial connection having an outer conductor connected to a wall of the cavity and an inner conductor connected to a point on said plate substantially removed from its mid-point.

4. An antenna comprising:
a resonant cavity having plural radiating slots formed in the surface of one wall thereof,
an electrically conducting plate disposed within said cavity and substantially spaced from all internal cavity walls thereby lengthening the effective electrical resonant dimensions of the cavity for a given physical size of cavity, and
feed means electrically connected to said plate at one or more points substantially removed from the plate midpoint for coupling radio frequency electrical signals to/from said slots in said resonant cavity and a source/receiver of such signals located externally of the cavity via said plate with predetermined relative phases.

5. An antenna as in claim 4 wherein said feed means comprises at least one coaxial connector having its outer conductor connected to a wall of said cavity and its inner conductor connected to said plate.

6. An antenna as in claim 4 wherein said feed means comprises only one coaxial connector having its outer conductor connected to a wall of said cavity and its inner conductor connected to said plate.

7. An antenna as in claim 4 wherein said feed means comprises a microstrip transmission line disposed above said resonant cavity.

8. An antenna as in claim 4 wherein said plate is shaped substantially similar to a cross section of said resonant cavity taken parallel to said one wall, said plate being smaller than said cross section in its respective dimensions.

9. An antenna as in claim 4 wherein said plate is substantially centrally disposed within said cavity.

10. An antenna as in claim 4 wherein said plate is electrically connected at least once to at least one wall of said cavity.

11. An antenna as in claim 4 further comprising a phase-shifting circuit connected at one point to said feed means and at plural other points, electrically displaced by different respective amounts from said one point, to at least one wall of said cavity.

12. An antenna as in claim 11 wherein said phase-shifting circuits are etched from a conductive layer bonded to one side of a dielectric sheet and said plate comprises another conductive layer bonded to the other side of said dielectric sheet.

13. In a crossed slot antenna having two intersection radiating slots formed in one wall of a resonant cavity, the improvement comprising:
an electrically conducting plate shaped substantially similar to a cross-section of said resonant cavity taken parallel to said one wall, but said plate being smaller than said cross-section in its respective dimensions,
said plate being disposed within said cavity and substantially spaced from all internal cavity walls thereby lengthening the effective electrical resonant dimensions of the cavity for a given physical size of cavity, and
feed means electrically connected to said plate at one or more points substantially removed from the plate midpont for coupling radio frequency electrical signals to/from said slots in said resonant cavity and a source/receiver of such signals located externally of the cavity via said plate with predetermined respectively corresponding relative phase relationships.

14. An improved crossed slot antenna as in claim 13 wherein said plate is substantially centrally disposed within said cavity.

15. An improved crossed slot antenna as in claim 13 wherein said plate is electrically connected at least once to at least one wall of said cavity.

16. An improved crossed slot antenna as in claim 13 further comprising a phase-shifting circuit connected at one point to said feed means and at plural other points, electrically displaced by different respective amounts from said one point, to at least one wall of said cavity.

17. An improved crossed slot antenna as in any of claims 13–16 wherein said resonant cavity is shaped as a circular cylinder and said radiating slots intersect so as to form equally spaced angular intervals therebetween.

18. An improved crossed slot antenna as in claim 17 wherein said plate comprises an electrically conductive layer bonded to one side of a dielectric sheet of material.

19. An improved crossed slot antenna as in claim 18 wherein said phase-shifting circuit comprises microstrip circuits etched from an electrically conductive layer bonded to the other side of said dielectric sheet.

20. An improved crossed slot antenna as in claim 17 wherein said plate has unequal dimensions along two orthogonal axes and wherein said feed means is electrically connected thereto at a point located substantially equidistant from said axes.

21. An improved crossed slot antenna as in claim 20 wherein said axes are substantially aligned with said radiating slots.

22. An improved crossed slot antenna as in any of claims 13–16 wherein said resonant cavity is shaped with a polygon cross-section and said radiating slots are disposed substantially symmetrically with respect to the sides of said polygon.

23. An improved cross slot antenna as in any of claims 13–16 wherein said feed means comprises a microstrip transmission line disposed above said resonant cavity.

24. A crossed slot antenna comprising:

a resonant cavity defined at least in part by first and second spaced-apart opposingly disposed electrically conductive surfaces which are electrically connected together to define the boundaries of said cavity, at least two intersecting radiating slots formed in said first surface, a third electrically conductive surface of lesser dimensions than said first and second surfaces, said third surface being disposed within said resonant cavity and being substantially symmetric in shape and disposition with respect to each of said radiating slots, and feed means electrically connected to said third surface at one or more points substantially removed from the midpoint of said third surface for coupling radio frequency electrical signals to/from said slots in said resonant cavity and a source/receiver of such signals located externally of the cavity via said plate with predetermined respectively corresponding relative phase relationships.

25. A crossed slot antenna as in claim 24 wherein said third surface is also disposed substantially mid-way between said first and second surfaces.

26. A crossed slot antenna as in claim 24 wherein said third surface is also connected, at least one point, to one of said first and second surfaces.

27. A crossed slot antenna as in claim 24 further comprising a phase-shifting circuit connected at one point to said feed means and at plural other points, electrically displaced by different predetermined amounts from said one point, to at least one of said first and second surfaces.

28. A crossed slot antenna as in any of claims 24–27 wherein said resonant cavity is shaped as a circular cylinder and said radiating slots intersect so as to form equally spaced angular intervals therebetween.

29. A crossed slot antenna as in claim 28 wherein said third surface is approximately circular in shape and the diameter of said cavity is approximately one-half wavelength at its resonant frequency.

30. A crossed slot antenna as in claim 28 wherein said third surface comprises an electrically conductive layer bonded to one side of a dielectric sheet of material.

31. A crossed slot antenna as in claim 30 wherein said phase-shifting circuit comprises microstrip circuits etched from an electrically conductive layer bonded to the other side of said dielectric sheet.

32. A crossed slot antenna as in claim 28 wherein said third surface has unequal dimensions along two orthogonal axes and wherein said feed means is electrically connected thereto at a point located substantially equidistant from said axes.

33. A crossed slot antenna as in claim 32 wherein said axes are substantially aligned with said intersecting slots.

34. A crossed slot antenna as in any of claims 24–27 wherein said resonant cavity is shaped with a polygon cross-section and said radiating slots are disposed substantially symmetrically with respect to the sides of said polygon.

35. A crossed slot antenna as in claim 34 wherein said third surface is smaller but shaped substantially similarly to said polygon.

36. A crossed slot antenna as in claim 35 wherein said polygon is an equilateral triangle.

37. A crossed slot antenna as in any of claims 24–27 wherein said feed means comprises a strip transmission line disposed above said resonant cavity.

* * * * *